US011707856B2

(12) United States Patent
Ye et al.

(10) Patent No.: US 11,707,856 B2
(45) Date of Patent: Jul. 25, 2023

(54) KNIFE THAT CAN BE QUICKLY ASSEMBLED AND DISASSEMBLED

(71) Applicant: Longquan Qi Sen Bamboo Crafts Co., Ltd, Zhejiang (CN)

(72) Inventors: Jianchun Ye, Zhejiang (CN); Shaorong Mao, Zhejiang (CN); Zhen Ye, Zhejiang (CN); Qingping Hu, Zhejiang (CN)

(73) Assignee: Longquan Qi Sen Bamboo Crafts Co., Ltd, Lishui (CN)

( * ) Notice: Subject to any disclaimer, the term of this patent is extended or adjusted under 35 U.S.C. 154(b) by 219 days.

(21) Appl. No.: 17/406,098

(22) Filed: Aug. 19, 2021

(65) Prior Publication Data

US 2022/0241993 A1 Aug. 4, 2022

(30) Foreign Application Priority Data

Feb. 2, 2021 (CN) ..... 202120289271.9

(51) Int. Cl.
*B26B 3/00* (2006.01)
*B25G 3/26* (2006.01)

(52) U.S. Cl.
CPC . *B26B 3/00* (2013.01); *B25G 3/26* (2013.01)

(58) Field of Classification Search
CPC .. B26B 3/00; B26B 5/00; B26B 5/001; B25G 3/26
USPC ..... 30/340, 342, 343, 344
See application file for complete search history.

(56) References Cited

U.S. PATENT DOCUMENTS 7,866,050 B2 * 1/2011 Yu ..... B26B 1/10 30/342
2003/0221323 A1 * 12/2003 DeAsis ..... B25G 3/32 30/340
2020/0391397 A1 * 12/2020 Cauley, Jr. ..... B26B 5/00

* cited by examiner

*Primary Examiner* — Phong H Nguyen

(57) ABSTRACT

A knife that can be quickly assembled and disassembled comprises a blade and a handle that are removably connected to each other through a connection assembly, and further comprises a knife clip, a knife disc and a handle ring. The left end of the blade is provided with a knife rod. A step is provided at the connection between a main body of the blade and the knife rod. A knife clip is sleeved outside of the step. The handle ring and the knife disc are provided parallel on the left and right sides respectively, and are respectively sleeved outside of the knife rod. The handle comprises a handle sleeve and a built-in sleeve that is fixed at the right end of the inner hole of the handle sleeve.

9 Claims, 7 Drawing Sheets

KNIFE THAT CAN BE QUICKLY ASSEMBLED AND DISASSEMBLED

CROSS REFERENCE TO RELATED APPLICATIONS

The present application is based on and claims the priority benefits of Chinese Patent Application No. 202120289271.9, filed on Feb. 2, 2021. The entirety of the above-mentioned patent application is hereby incorporated by reference herein and made a part of this specification.

BACKGROUND

Technical Field

The present application relates to the technical field of the knife, in particular to the technical field of the knife that can be quickly assembled and disassembled.

Description of Related Art

For a conventional knife, a blade and a handle thereof are usually designed in one piece, occupying a large area, and thus the transportation cost is high, especially for exporting.

SUMMARY

The purpose of the present application is to solve the problems in the prior art, and propose a knife that can be quickly assembled and disassembled, in which a blade and a handle can be disassembled during transportation, and then assembled at the destination, thereby greatly saving transportation costs and improving market competitiveness.

In order to achieve the above purpose, the present application proposes a knife that can be quickly assembled and disassembled. It comprises a blade and a handle, wherein an end of the blade is provided with a knife rod, and an end of the handle far away from the blade is removably connected to an end of the knife rod far away from the blade through a connection assembly.

In some embodiments, the knife further comprises a knife clip, a knife disc and a handle ring; a step is provided at the connection between the main body of the blade and the knife rod; the knife clip is sleeved outside of the step; the handle ring and the knife disc are adjacently sleeved outside of the knife rod, and the knife disc is located between the knife clip and the handle ring; the handle comprises a handle sleeve and a built-in sleeve that is fixed at an end of the inner hole of the handle sleeve; and an end of the knife rod far away from the blade is provided with a rod hole, and extends into the inner hole of the handle sleeve after passing through the built-in sleeve.

In some embodiments, the central part of the knife disc is provided with a disc through hole for the knife rod to pass through, and the two sides of the knife disc are respectively provided with a first disc insert opening for the handle ring to be inserted and a second disc insert opening for the knife clip to be inserted.

In some embodiments, the peripheral region of the knife disc is surroundingly provided with several hollow openings.

In some embodiments, the handle ring comprises a ring plate and a ring sleeve that is fixed at a side of the ring plate, and the central part of the ring plate is provided with a plate through hole through which the knife rod extends.

In some embodiments, the connection assembly comprises a tail fixing ring and a tie, the tail fixing ring is fixed by snap fit at an end of the handle sleeve far away from the built-in sleeve, a bar is connected to an inner wall of the tail fixing ring at both ends thereof, and the tie after passing through the rod hole is bound and fixed to the bar.

In some embodiments, a periphery of a side of the tail fixing ring adjacent to the handle sleeve is provided with a ring groove.

In some embodiments, the connection assembly comprises a link rod, a tail fixed piece and a bolt; the tail fixed piece is fixed by snap fit at an end of the handle sleeve far away from the built-in sleeve; the central part of the tail fixed piece is provided with a through opening; an end of the link rod adjacent to the knife rod is threadedly connected to the end of the knife rod far away from the blade; an end of the link rod far away from the knife rod is located within the handle sleeve; the bolt after passing through the through opening is connected with the end of the link rod far away from the knife rod.

In some embodiments, the end of the link rod adjacent to the knife rod at the central part is provided with a notch so as to form a clevis that clamps outside of the end of the knife rod far away from the blade and is provided with a rod through hole corresponding with the rod hole, and the end of the link rod far away from the knife rod is provided with an internally threaded connector.

In some embodiments, a periphery of a side of the tail fixed piece adjacent to the handle sleeve is provided with an annular groove.

The beneficial effects of this present application are as follows. By changing the integrated blade and handle into the blade removably connected to the handle in the present application, the knife can be disassembled during transportation and then assembled at the destination, thereby greatly saving transportation costs and improving market competition. The blade and the handle can be tied and fixed by the tie and the tail fixing ring, or are threadedly connected to each other by the link rod, the bolt and the tail fixed piece, which has a simple structure, a quick installation and a low cost. By using the built-in sleeve fixed in the handle sleeve, the stability of the connection is greatly improved and the blade is prevented from shaking during the use.

BRIEF DESCRIPTION OF THE DRAWINGS

The features and advantages of the present application will be described in detail through embodiments in conjunction with the drawings.

DESCRIPTION OF THE EMBODIMENTS

The First Example

Figure 1:
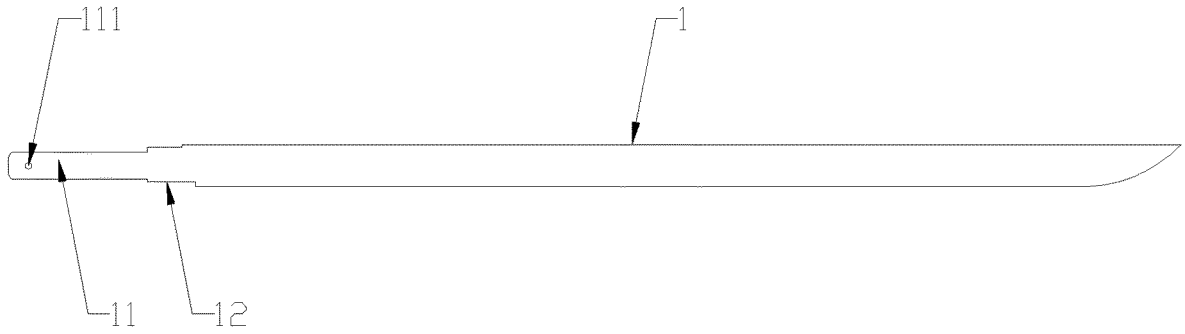
FIG. 1 is a front view of a blade of a knife that can be quickly assembled and disassembled of the present application.
Figure 2:
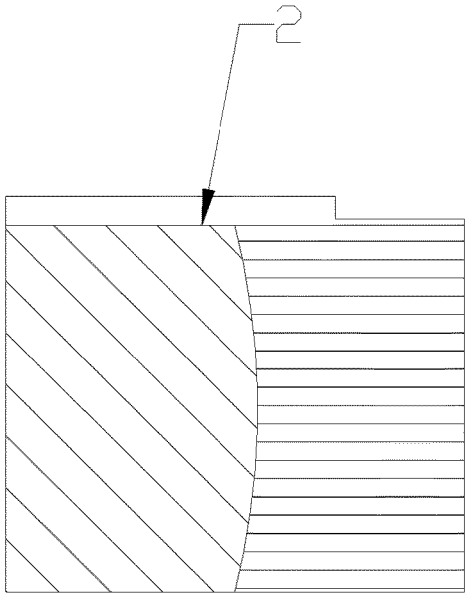
FIG. 2 is a front view of a knife clip of the knife that can be quickly assembled and disassembled of the present application.
Figure 3:
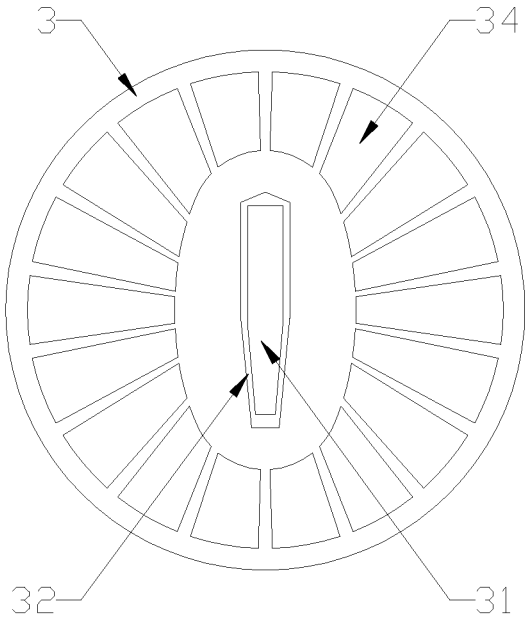
FIG. 3 is a right view of a knife disc of the knife that can be quickly assembled and disassembled of the present application.
Figure 4:
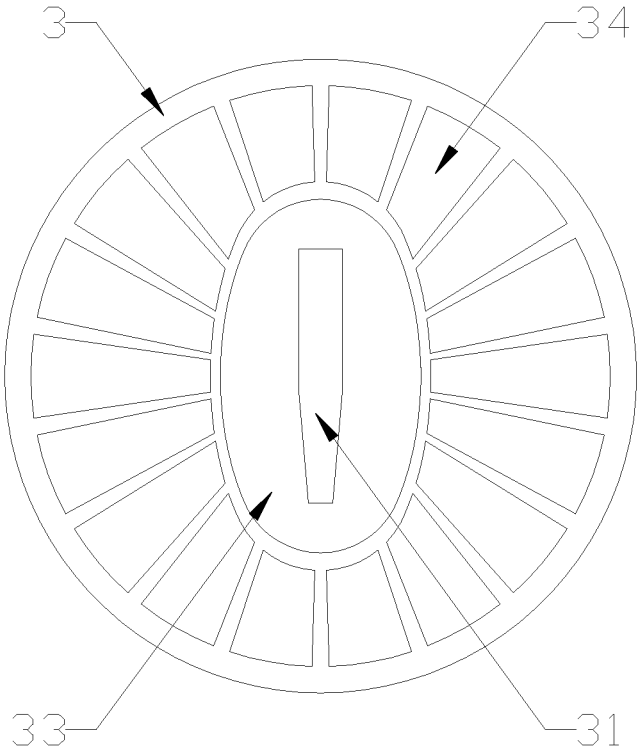
FIG. 4 is a left view of the knife disc of the knife that can be quickly assembled and disassembled of the present application.
Figure 5:
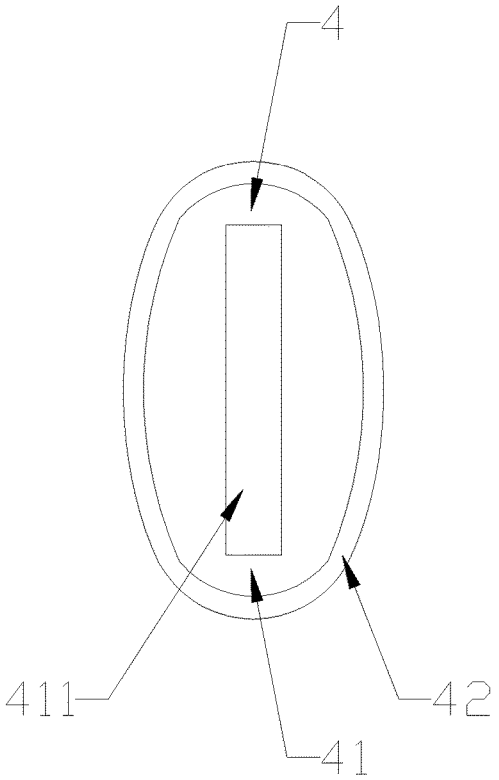
FIG. 5 is a left view of a handle ring of the knife that can be quickly assembled and disassembled of the present application.
Figure 6:
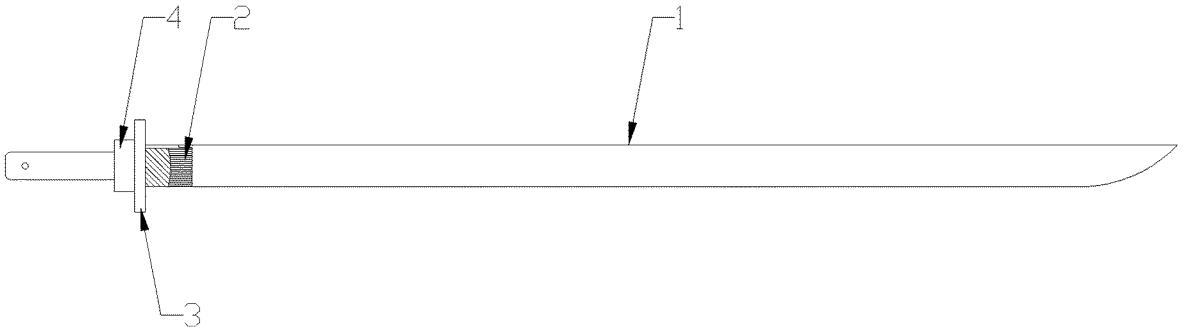
FIG. 6 is a schematic view for the installation of a blade, a knife clip, a knife disc and a handle ring of the knife that can be quickly assembled and disassembled of the present application.
Figure 7:
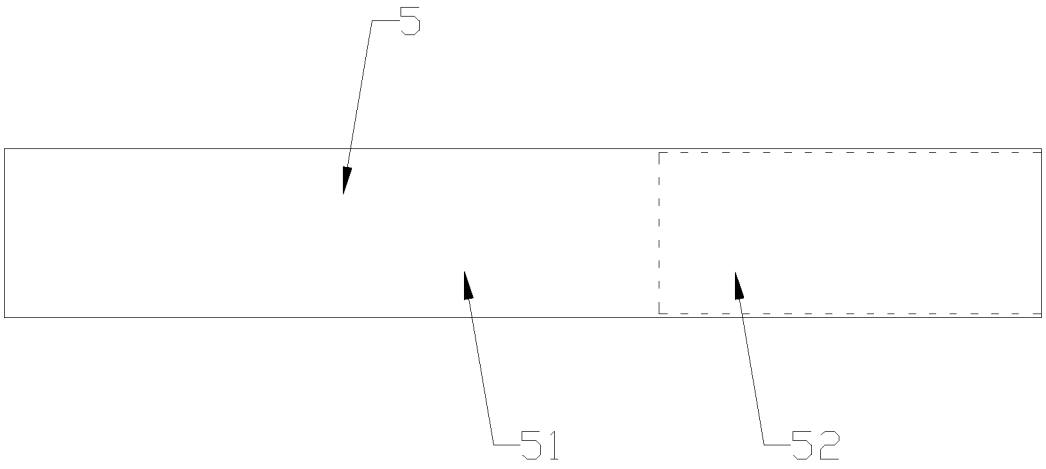
FIG. 7 is a front view of a handle of the knife that can be quickly assembled and disassembled of the present application.
Figure 8:
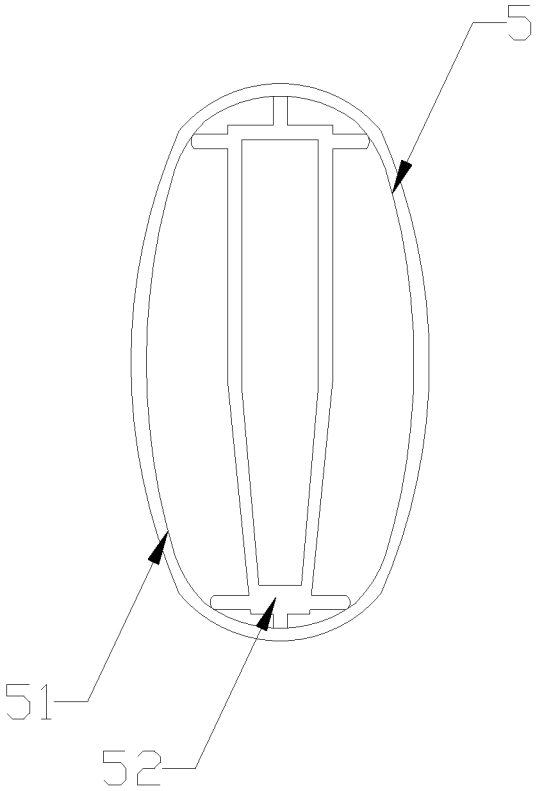
FIG. 8 is a right view of the handle of the knife that can be quickly assembled and disassembled of the present application.
Figure 9:
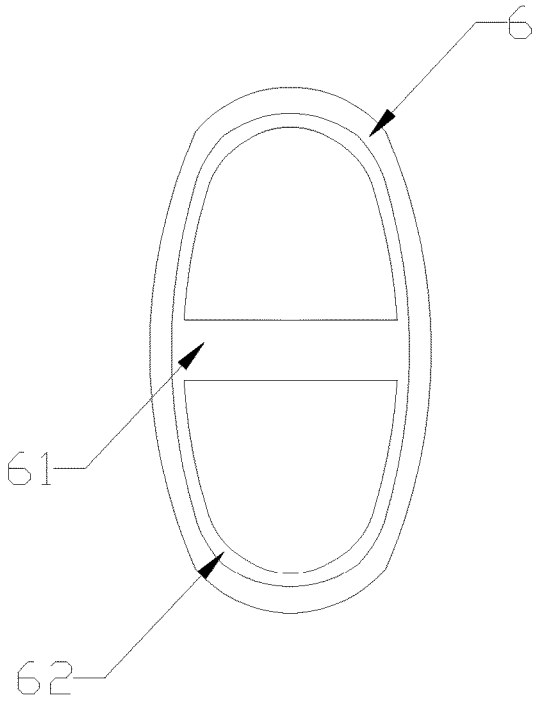
FIG. 9 is a right view of a tail fixing ring of the knife that can be quickly assembled and disassembled of the present application.
Figure 10:
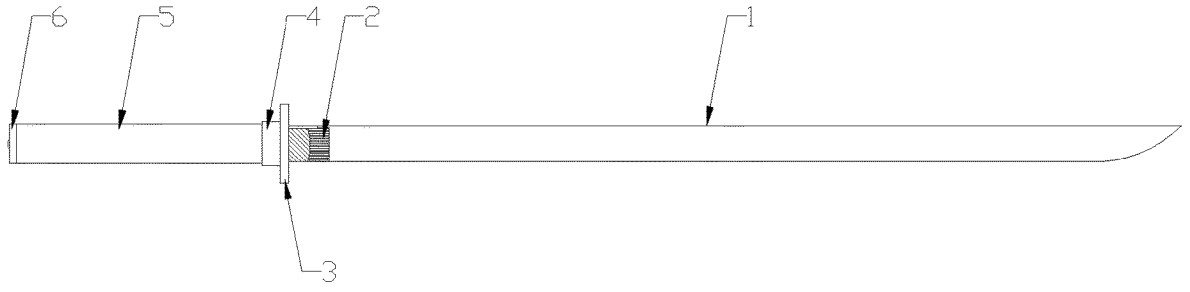
FIG. 10 is a front view of the first example.

Referring to FIGS. 1-10, a knife that can be quickly assembled and disassembled of the present application comprises a blade 1 and a handle 5 that are removably connected to each other through a connection assembly.

It further comprises a knife clip 2, a knife disc 3 and a handle ring 4. A step 12 is provided at the connection between the main body of the blade 1 and the knife rod 11. The knife clip 2 is sleeved outside of the step 12. The handle ring 4 and the knife disc 3 are adjacently sleeved outside of the knife rod 11, and the knife disc 3 is located between the knife clip 2 and the handle ring 4; the handle 5 comprises a handle sleeve 51 and a built-in sleeve 52 that is fixed at an end of the inner hole of the handle sleeve 51. An end of the knife rod 11 far away from the blade 1 is provided with a rod hole 111, and an end of the knife rod 11 far away from the blade 1 extends into the inner hole of the handle sleeve 51 after passing through the built-in sleeve 52.

The central part of the knife disc 3 is provided with a disc through hole 31 for the knife rod 11 to pass through, and the two sides of the knife disc 3 are respectively provided with a first disc insert opening 32 for the handle ring 4 to be inserted and a second disc insert opening 33 for the knife clip 2 to be inserted.

The peripheral region of the knife disc 3 is surroundingly provided with several hollow openings 34.

The handle ring 4 comprises a ring plate 41 and a ring sleeve 42, and the central part of the ring plate 41 is provided with a plate through hole 411 through which the knife rod 11 extends. The ring sleeve 42 is fixed at a left side of the ring plate 41.

The connection assembly comprises a tail fixing ring 6 and a tie, the tail fixing ring 6 is fixed by snap fit at an end of the handle sleeve 51 far away from the built-in sleeve 52, a bar 61 is connected to the inner wall of the tail fixing ring 6 at both ends thereof, and the tie after passing through the rod hole 111 is bound and fixed to the bar 61.

A periphery of a side of the tail fixing ring 6 adjacent to the handle sleeve 51 is provided with a ring groove 62.

During transportation, the various parts of the knife need to be disassembled and put into a packaging box in turn. After the knife is transported to the destination, they are assembled. When assembling, the knife clip 2 is sleeved at the step 12 of the blade 1 firstly, then the knife disc 3 and the handle ring 4 are sleeved outside of the knife rod 11 in turn, and then the knife clip 2 and the handle ring 4 are inserted into the first disc insert opening 32 and the second disc insert opening 33. Then, one end of the tie passes through the rod hole 111, and then the left end of the knife rod 11 and the tie pass through the built-in sleeve 52. Then, the tail fixing ring 6 is clamped to the left end of the handle sleeve 51, and then the tie bypasses the bar 61 and is bound and fixed, so as to realize the connection of the handle 5 and the blade 1.

The Second Example

Figure 11:
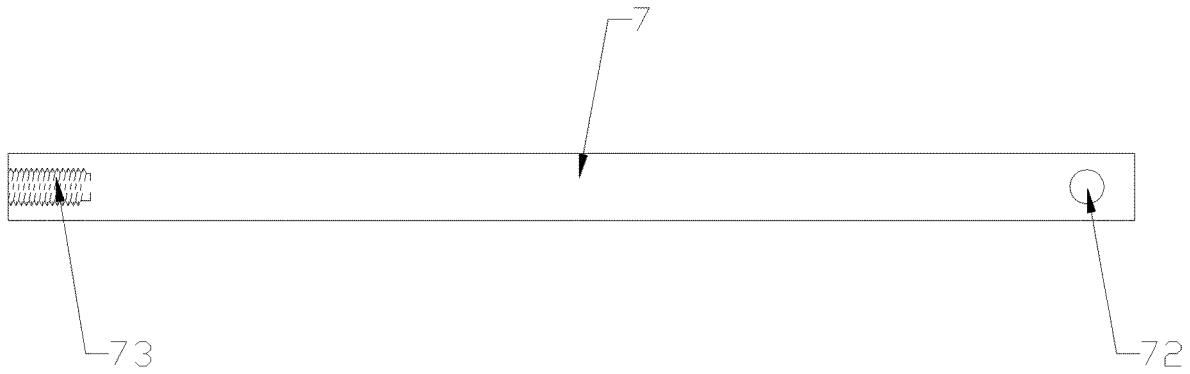
FIG. 11 is a front view of a link rod of the knife that can be quickly assembled and disassembled of the present application.
Figure 12:
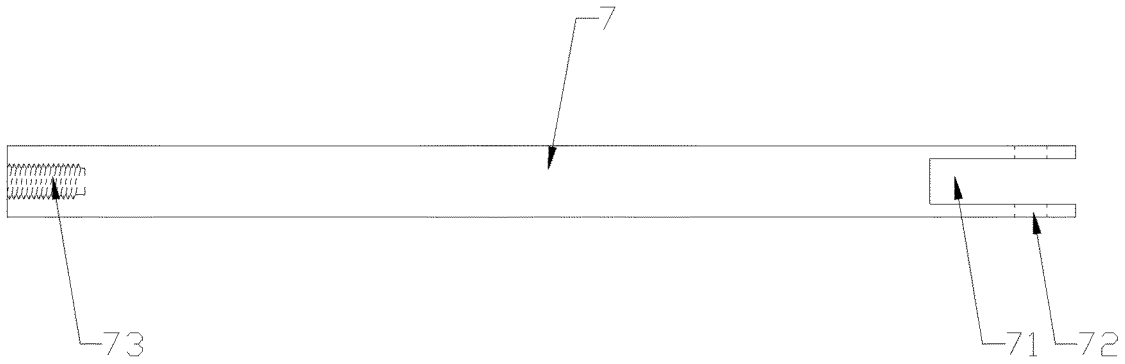
FIG. 12 is a top view of the link rod of the knife that can be quickly assembled and disassembled of the present application.
Figure 13:
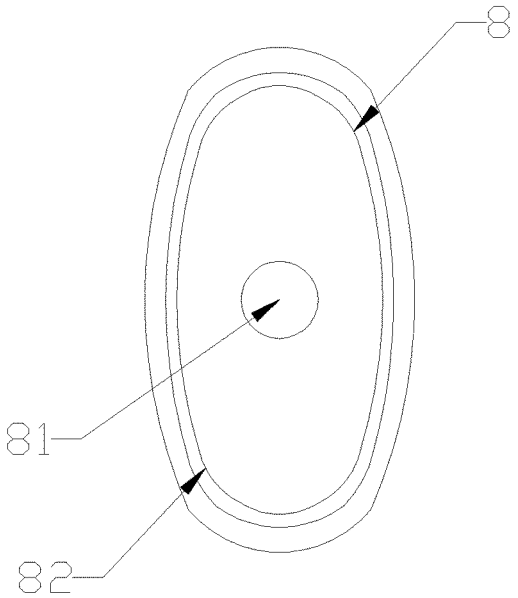
FIG. 13 is a right view of a tail fixed piece of the knife that can be quickly assembled and disassembled of the present application.
Figure 14:
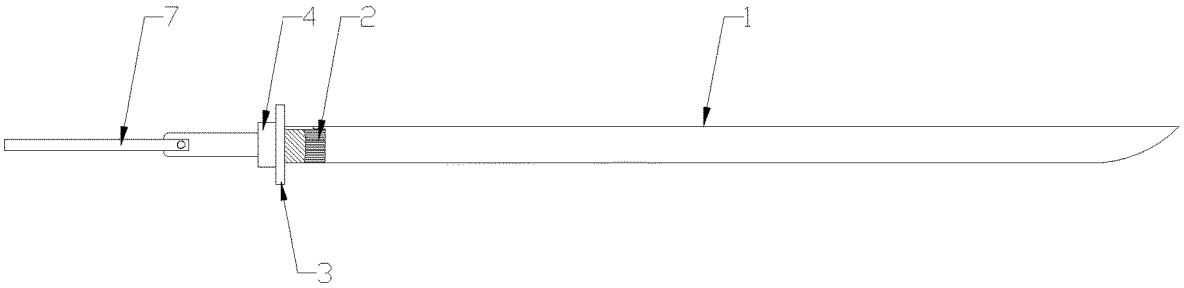
FIG. 14 is a schematic view for the installation of a blade, a knife clip, a knife disc and a handle ring and a link rod of the knife that can be quickly assembled and disassembled of the present application.
Figure 15:
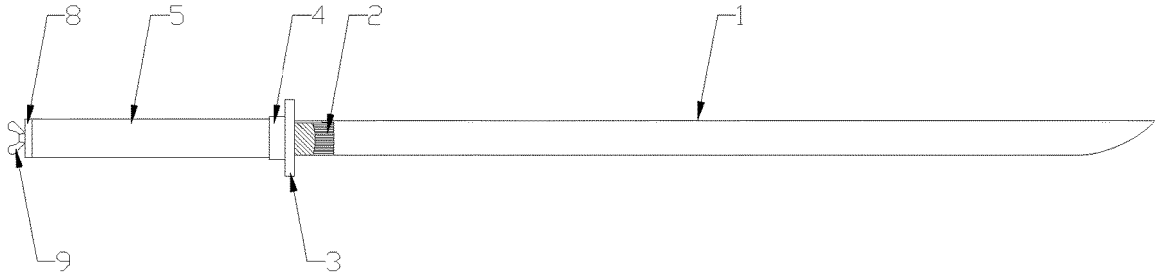
FIG. 15 is a front view of the second example.

Referring to FIGS. 1-8 and 11-15, the knife that can be quickly assembled and disassembled of the present application comprises a blade 1 and a handle 5 that are removably connected to each other through a connection assembly.

The knife further comprises a knife clip 2, a knife disc 3 and a handle ring 4. A step 12 is provided at the connection between the main body of the blade 1 and the knife rod 11. The knife clip 2 is sleeved outside of the step 12. The handle ring 4 and the knife disc 3 are adjacently sleeved outside of the knife rod 11, and the knife disc 3 is located between the knife clip 2 and the handle ring 4; the handle 5 comprises a handle sleeve 51 and a built-in sleeve 52 that is fixed at an end of the inner hole of the handle sleeve 51. An end of the knife rod 11 far away from the blade 1 is provided with a rod hole 111, and an end of the knife rod 11 far away from the blade 1 extends into the inner hole of the handle sleeve 51 after passing through the built-in sleeve 52.

The central part of the knife disc 3 is provided with a disc through hole 31 for the knife rod 11 to pass through, and the two sides of the knife disc 3 are respectively provided with a first disc insert opening 32 for the handle ring 4 to be inserted and a second disc insert opening 33 for the knife clip 2 to be inserted.

The peripheral region of the knife disc 3 is surroundingly provided with several hollow openings 34.

The handle ring 4 comprises a ring plate 41 and a ring sleeve 42, and the central part of the ring plate 41 is provided with a plate through hole 411 through which the knife rod 11 extends. The ring sleeve 42 is fixed at a left side of the ring plate 41.

The connection assembly comprises a link rod 7, a tail fixed piece 8 and a bolt 9; the tail fixed piece 8 is fixed by snap fit at an end of the handle sleeve 51 far away from the built-in sleeve 52; the central part of the tail fixed piece 8 is provided with a through opening 81; an end of the link rod 7 adjacent to the knife rod 11 is threadedly connected to the end of the knife rod 11 far away from the blade; an end of the link rod 7 far away from the knife rod 11 is located within the handle sleeve 51; and the bolt 9 after passing through the through opening 81 is connected with the end of the link rod 7 far away from the knife rod 11.

The end of the link rod 7 adjacent to the knife rod 11 at the central part is provided with a notch 71 so as to form a clevis that clamps outside of the end of the knife rod 11 far away from the blade 1 and is provided with a rod through hole 72 corresponding with the rod hole 111, and the end of the link rod 7 far away from the knife rod 11 is provided with an internally threaded connector 73.

A periphery of a side of the tail fixed piece 8 adjacent to the handle sleeve 51 is provided with an annular groove 82.

During transportation, the various parts of the knife need to be disassembled and put into a packaging box in turn. After the knife is transported to the destination, they are assembled. When assembling, the knife clip 2 is sleeved at the step 12 of the blade 1 firstly, then the knife disc 3 and the handle ring 4 are sleeved outside of the knife rod 11 in turn, and then the knife clip 2 and the handle ring 4 are inserted into the first disc insert opening 32 and the second disc insert opening 33. Then, the clevis at the right end of the link rod 7 is clamped at the left end of the knife rod 11, and the clevis and the knife rod 11 are threadedly connected to each other by using fasteners. Then, the left end of the link rod 7 passes through the built-in sleeve 52, and the tail fixed piece 8 is clamped at the left end of the handle sleeve 51, and then the tail fixed piece 8 and the link rod 7 are threadedly connected to each other by using the bolt 9, so as to realize the connection of the handle 5 and the blade 1.

The above-mentioned embodiments are explanation of the present application, not a limitation of the present application, and any scheme after a simple transformation of the present application belongs to the protection scope of the present application.

What is claimed is:

1. A knife that can be quickly assembled and disassembled, comprising:

a blade (1) and a handle (5), wherein an end of the blade (1) is provided with a knife rod (11), and an end of the handle (5) far away from the blade (1) is removably connected to an end of the knife rod (11) far away from the blade through a connection assembly;

wherein the knife further comprises a knife clip (2), a knife disc (3) and a handle ring (4); a step (12) is provided at a connection between a main body of the blade (1) and the knife rod (11); the knife clip (2) is sleeved outside of the step (12); the handle ring (4) and the knife disc (3) are adjacently sleeved outside of the knife rod (11), and the knife disc (3) is located between the knife clip (2) and the handle ring (4); the handle (5) comprises a handle sleeve (51) and a built-in sleeve (52) that is fixed at an end of an inner hole of the handle sleeve (51); the end of the knife rod (11) far away from the blade (1) is provided with a rod hole (111), and extends into the inner hole of the handle sleeve (51) after passing through the built-in sleeve (52).

2. The knife that can be quickly assembled and disassembled according to claim 1, wherein a central part of the knife disc (3) is provided with a disc through hole (31) for the knife rod (11) to pass through, and two sides of the knife disc (3) are respectively provided with a first disc insert opening (32) for the handle ring (4) to be inserted and a second disc insert opening (33) for the knife clip (2) to be inserted.

3. The knife that can be quickly assembled and disassembled according to claim 2, wherein the peripheral region of the knife disc (3) is surroundingly provided with several hollow openings (34).

4. The knife that can be quickly assembled and disassembled according to claim 2, wherein the handle ring (4) comprises a ring plate (41) and a ring sleeve (42) that is fixed at a side of the ring plate (41), and a central part of the ring plate (41) is provided with a plate through hole (411) through which the knife rod (11) extends.

5. The knife that can be quickly assembled and disassembled according to claim 2, wherein the connection assembly comprises a tail fixing ring (6) and a tie, the tail fixing ring (6) is fixed by snap fit at an end of the handle sleeve (51) far away from the built-in sleeve (52), a bar (61) is connected to an inner wall of the tail fixing ring (6) at both ends thereof, and the tie after passing through the rod hole (111) is bound and fixed to the bar (61).

6. The knife that can be quickly assembled and disassembled according to claim 5, wherein a periphery of a side of the tail fixing ring (6) adjacent to the handle sleeve (51) is provided with a ring groove (62).

7. The knife that can be quickly assembled and disassembled according to claim 2, wherein the connection assembly comprises a link rod (7), a tail fixed piece (8) and a bolt (9); the tail fixed piece (8) is fixed by snap fit at an end of the handle sleeve (51) far away from the built-in sleeve (52); the central part of the tail fixed piece (8) is provided with a through opening (81); an end of the link rod (7) adjacent to the knife rod (11) is threadedly connected to the end of the knife rod (11) far away from the blade; an end of the link rod (7) far away from the knife rod (11) is located within the handle sleeve (51); the bolt (9) after passing through the through opening (81) is connected with the end of the link rod (7) far away from the knife rod (11).

8. The knife that can be quickly assembled and disassembled according to claim 7, wherein the end of the link rod (7) adjacent to the knife rod (11) at the central part is provided with a notch (71) so as to form a clevis that clamps outside of the end of the knife rod (11) far away from the blade (1) and is provided with a rod through hole (72) corresponding with the rod hole (111), and the end of the link rod (7) far away from the knife rod (11) is provided with an internally threaded connector (73).

9. The knife that can be quickly assembled and disassembled according to claim 7, wherein a periphery of a side of the tail fixed piece (8) adjacent to the handle sleeve (51) is provided with an annular groove (82).

* * * * *